US010168072B2

(12) United States Patent
Lucas et al.

(10) Patent No.: US 10,168,072 B2
(45) Date of Patent: Jan. 1, 2019

(54) PORTABLE AND CONTAINERIZED MULTI-STAGE WASTE-TO-ENERGY RECOVERY APPARATUS FOR USE IN A VARIETY OF SETTINGS

(71) Applicants: Jean Lucas, Carlisle (CA); Jun Xiao, Burlington (CA)

(72) Inventors: Jean Lucas, Carlisle (CA); Jun Xiao, Burlington (CA)

( * ) Notice: Subject to any disclaimer, the term of this patent is extended or adjusted under 35 U.S.C. 154(b) by 103 days.

(21) Appl. No.: 15/408,524

(22) Filed: Jan. 18, 2017

(65) Prior Publication Data

US 2018/0202687 A1 Jul. 19, 2018

(51) Int. Cl.

| | |
|---|---|
| ***F24H 1/06*** | (2006.01) |
| ***F24H 1/18*** | (2006.01) |
| ***F24H 1/08*** | (2006.01) |
| ***F23G 5/027*** | (2006.01) |
| ***F23G 5/40*** | (2006.01) |
| ***F23G 5/50*** | (2006.01) |

(52) U.S. Cl.

CPC ..... *F24H 1/06* (2013.01); *F23G 5/0276* (2013.01); *F23G 5/40* (2013.01); *F23G 5/50* (2013.01); *F24H 1/08* (2013.01); *F24H 1/187* (2013.01)

(58) Field of Classification Search

CPC ... F24H 1/06; F24H 1/08; F24H 1/187; F23G 5/0276; F23G 5/40; F23G 5/50

See application file for complete search history.

(56) References Cited

U.S. PATENT DOCUMENTS

| | | | | |
|---|---|---|---|---|
| 4,144,824 | A * | 3/1979 | Bartling, Sr. | F23G 5/165 110/116 |
| 4,875,420 | A * | 10/1989 | Hay | F23G 5/16 110/215 |
| 4,941,415 | A * | 7/1990 | Pope | F23G 5/16 110/211 |
| 5,795,666 | A * | 8/1998 | Johnssen | C10J 3/00 429/411 |
| 7,384,610 | B2 * | 6/2008 | Lewis | F23G 5/40 110/240 |
| 8,297,271 | B2 * | 10/2012 | Cedar | F23B 20/00 110/188 |
| 2002/0020677 | A1 * | 2/2002 | Noll | C02F 9/00 210/766 |
| 2005/0115478 | A1 * | 6/2005 | Pope | F23G 5/002 110/229 |
| 2006/0272559 | A1 * | 12/2006 | Liu | F23G 5/085 110/250 |

(Continued)

*Primary Examiner* — Nathaniel Herzfeld

(74) *Attorney, Agent, or Firm* — The Rapacke Law Group, P.A.

(57) ABSTRACT

Embodiments described provide a mobile containerized waste-to-energy recovery apparatus which enables a multi-stage gasification/oxidation of a solid waste and provide an energy source from a plurality of releasably couple technologies including at least a heat exchanger, a thermoelectric generator, an organic Rankine cycle unit, and chiller/heat pump. The apparatus includes an integrated slide rail mechanism that allows each of the plurality of iso containers to be releasably attached to one another and attach a variety of interchangeable and universally coded part types therein to enable a multi-stage gasification/oxidation in at least the primary and secondary chambers n and provide a recovered energy at the heat recovery module.

17 Claims, 6 Drawing Sheets

(56) References Cited

U.S. PATENT DOCUMENTS

| | | | | |
|---|---|---|---|---|
| 2011/0243802 | A1* | 10/2011 | Ringheim | C10J 3/26<br>422/186.04 |
| 2012/0227680 | A1* | 9/2012 | Kerr | F01K 13/00<br>122/5 |
| 2012/0235423 | A1* | 9/2012 | O'Connor | F23G 5/40<br>290/1 R |
| 2014/0219873 | A1* | 8/2014 | Gueh | C10J 3/00<br>422/109 |
| 2014/0305926 | A1* | 10/2014 | Tummillo | F23G 5/0276<br>219/385 |

* cited by examiner

PORTABLE AND CONTAINERIZED MULTI-STAGE WASTE-TO-ENERGY RECOVERY APPARATUS FOR USE IN A VARIETY OF SETTINGS

FIELD

The embodiments presented relate to a waste-to-energy conversion apparatus, and in particular, to a portable and readily assemblable waste-to-energy conversion apparatus comprised of a plurality of combustion chambers housed within a plurality of equilateral dimensioned and releasably attached iso container including a heat recovery module which converts the gaseous effluent to an energy source.

BACKGROUND

Traditional incinerators have been used in the United States since the early 19$^{th}$ century and were originally constructed to convert waste materials into ash, flue gas, and waste heat by combusting the organic substances within a loaded waste material. These initial forms of incineration released harmful gaseous and particulate directly into the environment without prior "scrubbing." When emitted into the air, fine particulates, heavy metals, trace dioxin and acid gas were later inhaled by third-parties.

Today waste incineration and the inability to properly handle ash and heavy metals remain dangerous to the environment and toxic to humans. In response to this hazard, lobbying has led to a new generation of cleaner waste-to-energy innovation. Included within these innovations are systems which incorporate thermal and non-thermal applications including advanced incineration, gasification, and pyrolysis which are able to convert the gaseous effluents into electrical energy.

Though much of this technology has enjoyed vast improvements which are now regulated by government standards, many of these new systems and devices remain bulky and inefficient.

Though there are several devices and systems for waste-to-energy recovery such as U.S. Pat. App. No. 2011/0036280 to Toase et al.; U.S. Pat. No. 5,553,554 to Urich; and European Patent No. 0776,962 to Fujimura et. al., there is not a single reference which discloses a highly portable and readily assemblable waste-to-energy apparatus which may be set up using an integrated rail system by a single operator and coupled with a plurality of technologies to create multiple energy sources.

SUMMARY OF THE INVENTION

Embodiments described herein provide a portable and containerized multi-stage energy recovery apparatus configured to be coupled with a plurality of releasably attachable technologies to generate a variety of energy from the gaseous effluent generated during a multi-stage gasification/oxidation of solid waste. The presented embodiments provide a portable and readily assemblable apparatus comprised of a plurality of combustion chambers which may be aligned and connected using an integrated slide rail mechanism within a portion thereof. The plurality of combustion chambers are configured to provide a multi-stage gasification/oxidation and selectively direct the gaseous effluent to either the main exhaust stack or heat recovery module. If directed toward the heat recovery module (i.e. heat recovery mode), a contained heat exchanger having a plurality of container water pipes is heated through convection and the heated liquid circulated to at least one storage tanks which are programmable using a microcontroller.

The apparatus includes a plurality of combustion chambers including a dual chamber first and second compartments in fluid communication via an air duct and having at least one blower and fuel operated burner, a breech/control module housing the microcontroller and remotely operate main control panel, a releasably attached heat recovery module, and at least one releasably attached water tank within a heat recovery system.

The apparatus enable a single operator to readily assemble the at least one air duct, blower, and burner by aligning the interchangeable components along an integrated slide rail mechanism and secure them into place using a plurality of securing pins. Further attached to the plurality of combustion chambers is an adjustable main exhaust stack and heat recovery exhaust stack. During use, waste is batch loaded within the primary gasification chamber and heated to a pre-selected set point temperature where the waste is gasified in both the first and second chambers. The gaseous effluent may then be selectively directed to a heat exchanger with where up to the at least 500 gallons of heated liquid may be stored in the at least one storage tanks. The apparatus is further configured to allow the gaseous effluent to be exhausted out of the main exhaust stack if the heat recovery module is not utilized or after the at least 500-gallon capacity is reached.

The microcontroller is configured to control the water pump and operation of the blowers and burners within the first and second chambers which are monitored using at least one sensor to maintain the pre-selected set point temperature.

The heat recovery module may be coupled with a plurality of technologies to create a variety of energy sources including at least a heat exchanger, thermoelectric generator, organic Rankine cycle unit, and a chiller/heat pump.

Other aspects, advantages, and novel features of the embodiments will become apparent from the following detailed description in conjunction with the drawings.

BRIEF DESCRIPTION OF THE DRAWINGS

A more complete understanding of the embodiments, and the attendant advantages and features thereof, will be more readily understood by reference to the following detailed description when considered in conjunction with the accompanying drawings wherein.

DETAILED DESCRIPTION

The specific details of the single embodiment or variety of embodiments described herein are set forth in this application. Any specific details of the embodiments are used for demonstration purposes only, and no unnecessary limitation or inferences are to be understood therefrom. Furthermore, as used herein, relational terms, such as "first" and "second," "top" and "bottom," and the like, may be used solely to distinguish one entity or element from another entity or element without necessarily requiring or implying any physical or logical relationship, or order between such entities or elements.

The embodiments provide a highly portable and readily assemblable containerized waste-to-energy conversion apparatus which enables recovered gaseous effluent to be converted a plurality of energy sources using releasably attached energy generation systems. The apparatus includes at least a primary and secondary combustion chamber, breech/control chamber, and heat recovery module chamber which are releasably secured to one another using a locking mechanism and collectively affixed to an integrated skid type base. The apparatus is designed to enable a single operator to releasably attach each iso container, air duct, and blower and burner using an integrated slide rail mounted system without the need for heavy equipment such as a crane or forklift to make the connections.

The apparatus is controlled by a microcontroller having an integrated storage and remotely connected to a main control panel housed within the breech/control chamber. During operations, an operator may batch load up to 1000 pounds of waste per day within the primary gasification chamber which provides for over 96% reduction of the load waste mass. Upon completion of the time gasification (i.e., burn cycle), the apparatus initiate a cool-down mode and operator is allowed to open the door to remove the ash collected.

In contrast to the present embodiments, traditional mobile waste processing systems are typically housed within a single 20-foot iso container and often requires manual separating of the solid waste before it's placed within shredders further mass reduction and homogeneity. The shredder not only reduces the mass of the solid waste but mix the waste to create a homogenous product before gasification or incineration. Most traditional systems which are housed within a single unit are not able to regulate air intake which often reduces efficiency levels to a mere 30-40% efficiency of volume reduction.

Figure 1:
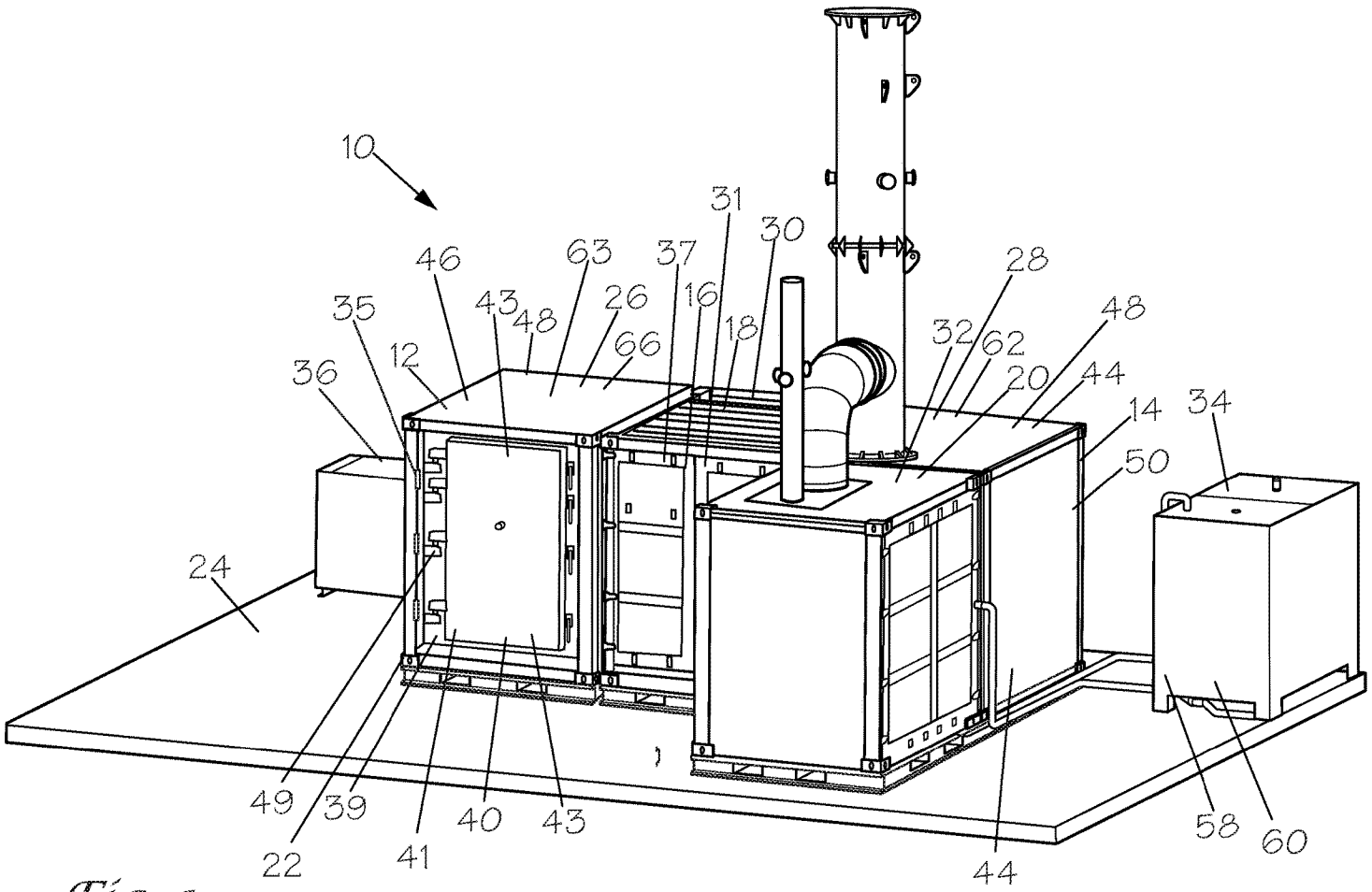
FIG. 1 is a perspective view of a containerized multi-stage waste-to-energy recovery apparatus.

Referring now to the drawings wherein like reference numerals designate identical or corresponding parts throughout the views. There is shown in FIG. 1 a mobile and readily assemblable containerized multi-stage waste-to-energy recovery apparatus 10. The apparatus 10 includes a plurality of combustion chambers 12 housed within a plurality of equilateral dimensioned iso containers 14, a microcontroller 16 remotely connected to main control panel 18, and a heat recovery module 20. It is contemplated the apparatus 10 is secured to an integrated skid type base 22 to facilitate convenient transportation. The portable apparatus 10 is dimensioned and lighter weight to allow for transport using a variety of transport platforms including at least a semi-trailer, helicopter, or within the cargo bay of transport aircraft and readily assembled by a single operator on-site using an integrated slide rail mechanism 23 and a forklift.

The plurality of combustion chambers 12 further includes at least a primary gasification chamber 26, a second combustion chamber 28, a breech control chamber 30, and heat recovery chamber 32 in fluid connection with the at least 500-gallon water storage tank 34. Each of the plurality of equilateral dimensioned combustion chambers (change wording) 12 is approximately 8.0 feet long, 6.5 feet wide, and 8.0 high with a steel exterior and vary in weight from 7,500-10,000 lbs.

The primary gasification chamber 26 includes a ceramic fiber refractory lining 35 (further illustrated in FIG. 5) about the interior surface 36 which increases the thermal shock resistance within the primary gasification chamber 26 during the gasification cycle (i.e., burn cycle) and enables over 96% reduction in mass of the gasified waste. The dual chamber design having a separate chamber 28 for the oxidation optimizes the efficient and complete oxidation of the gaseous effluent the plurality of combustion chambers 12 which are connected by an air duct 37 housed within the breech/control chamber 30 having a variable speed blower 31 to create a turbulent fluid mixture of the contained air/gas to provide a multi-stage gasification/oxidation of the loaded waste. Before use, waste is loaded through the door 39 where is placed on a metallic grate 40 just above the ceramic mortar floor surface 41 having at least one removable grate which enables the separation of the ash from metals and increases air circulation inside the gasification chamber improving the conversion of fixed carbon to carbonaceous gas inside the chamber. Once fully loaded, the door 39 is closed, and the integrated interlock is engaged. A primary burner blower 46 and secondary burner blower 48 are cycled for a pre-determined period to exhaust any residue gas from a previous gasification before the burners are ignited.

The apparatus 10 is further equipped with a plurality of safety features 49 which are designed to protect an operator by immediately initiating a shutdown of the system terminating any gasification/oxidation within the primary gasification chamber 26 or secondary oxidation chambers 28.

The primary gasification chamber 26 and secondary oxidation chamber 28 are fluidly connected by an elongated air duct 37 which controls the flow of air and gas between chambers. The air duct 37 which is configured to be aligned and secured using the integrated slide rail system 23 within the breech/control chamber 30. The air duct 37 is connected to the variable speed blower 31 which transfers creates turbulent mixing and oxygenation of the flue gas from the air starved gasification chamber 26 as it enters the secondary oxidation chamber 28 and enables a reduction in mass of the loaded solid waste by at least 96%.

The operator is able to access the primary gasification chamber 26 using the door 40 where any non-combusted inorganic solid waste is removed after the 4-6-hour gasification (i.e., burn cycle) and cool-down cycles.

Figure 2:
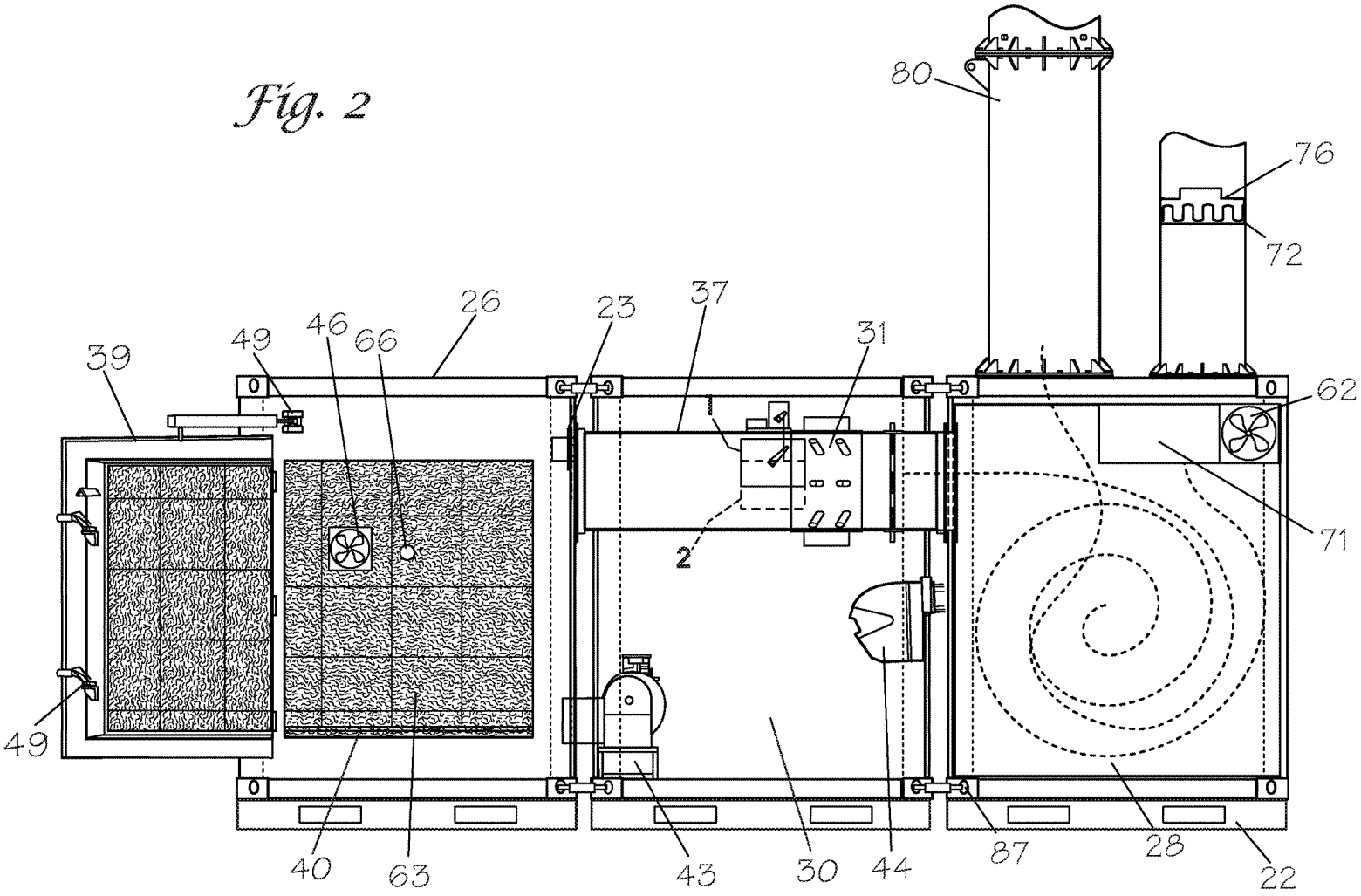
FIG. 2 is a cross-sectional view of the apparatus during a gasification/oxidation.

Further illustrated in FIG. 1 and located adjacent to the heat recovery module 32 is the plurality of water storage tanks 34 which provide the at least 500-gallon capacity which may be controlled using a water circulation pump 58 and valve system 60. Opposite the at least one water storage tanks 34 is an external fuel bladder or fuel tank 61 which supplies the primary 46 and secondary burner 62. Shown in FIG. 2 is a cross-sectional view of the apparatus 10 with the door 39 open. The apparatus 10 is designed to enable a single operator to batch load up to one thousand pounds of waste through the main door 39. Once the waste is placed onto the metallic grate 40 above the ceramic mortar floor surface 41, the main door 39 is sealed and interlock initiated. The burn cycle may be started either automatically using a programmed cycle or manually operated at the main control panel 64 remotely connected with the microcontroller 16 housed within the breech/control chamber 30. Once started, the primary burner blower 48 are secondary burner blower 50 are run for a pre-determined 2-minute interval using at timer 66 to exhaust any gaseous residue.

Upon expiration of the pre-determined 2-minute interval, the secondary burner 62 is ignited and runs on high fire until the set 850-1000-degree Celsius set point temperature is achieved within the secondary oxidation chamber 28. The primary burner 46 is pre-programmed at the microcontroller 16 to ignite once the 650-800 degree Celsius set point temperature in the Secondary Oxidation Chamber 28 is achieved. The gasification process begins by adding heat to the gasification chamber and drying any wet/moist waste and then decomposing the contained organic molecules of the solid waste to form a gas and vapor mixture comprised of water, carbon monoxide, carbon dioxide, hydrogen, methane, and ethane. Once the gasification process is complete, any remaining non-combustibles are removed along with the ash.

The primary burner/blower 48 of the primary gasification chamber 26 are electrically connected to at least one sensor 63 which monitors the temperature of the plurality of combustion chambers 12 and provides a return signal to the microcontroller 16 to modulate a burner switch between at least the on/off positions to maintain the pre-determined set point temperature. In contrast to traditional pyrolysis systems which are often limited in their processing capacity due to a lack of air drawn into the process, the primary gasification chamber 26 of the present apparatus 10 operates under "starved air" conditions which results in improved burn-out of fixed carbon but generating less dust and particulate matter than excess-air incinerators.

The secondary oxidation chamber 28 is further configured to modulate the secondary burner 62 using an internal burner management system. The secondary blower 62 is controlled by a variable frequency drive electrically connected to the microcontroller 16 and the at least one sensor 63 modulates the motor speed using both frequency and voltage motor inputs to maintain the set point temperature.

During the gasification/oxidation process, when in heat recovery mode, the gaseous effluent exhaust is directed to the heat recovery module 20 using a draft induction blower 71 to direct fluid flow to the heat exchanger 72 affixed within the heat recovery module 20. During the gasification/oxidation in which the gaseous effluent exhaust is in fluid communication with the heat exchanger 72, the liquid contained within the plurality of water tubes 76 is heated and circulated using the water circulation pump 78 before being contained within the plurality of water storage tanks 34. When utilizing the heat recovery module, a flow rate of up to 8 gallons/min. of water is achieved until the at least 500-gallon capacity is reached and the gaseous effluent is redirected from the heat recovery stack 74 to the main exhaust stack 80.

The gasification/oxidation process is pre-programmed on a countdown timer 66 based on the operator input to the microcontroller and burn cycle/loading conditions. Once a burn cycle is complete, the apparatus 10 is configured to enter a cool-down mode in which the primary burner 61 and secondary burner 62 are extinguished, and the primary gasification chamber blower 48 is used to exhaust the contained heat within the primary gasification chambers 26. Like the burn cycle which is operated with a countdown timer, the cool-down mode may be pre-programmed for a period based on a variety of factors. For example, if the apparatus is transported to a location with minimal solid waste, the countdown timer 66 may adjust the both the burn cycle and cool-down cycles at the microcontroller 16 to conserve fuel. In contrast, if the apparatus 10 is required to process more waste, the countdown timer 66 may be extended to ensure adequate time for conversion of the waste and cooling of the plurality of combustion chambers 12.

Figure 3:
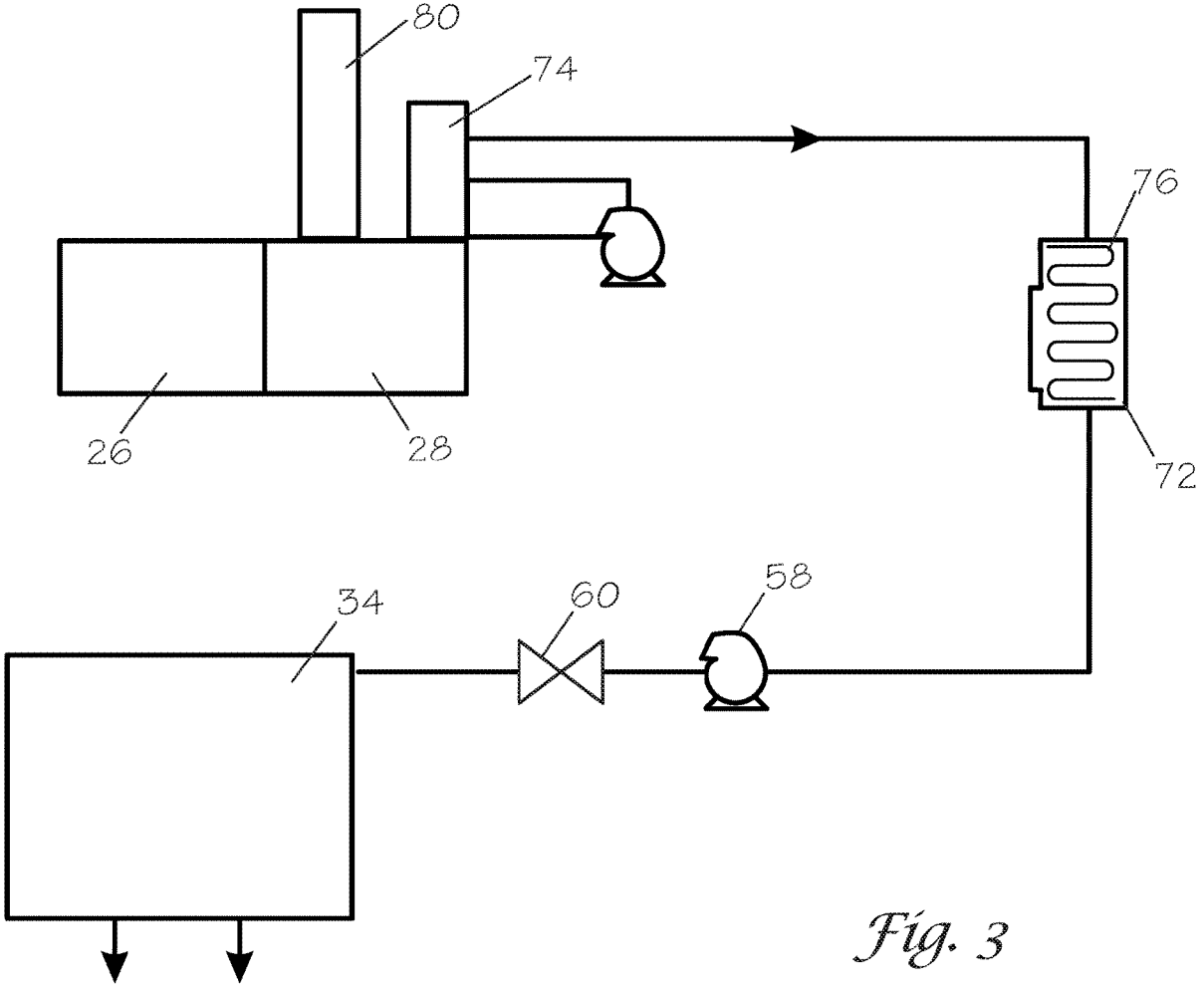
FIG. 3 is a schematic view of the apparatus including the releasably attached heat exchanger.

Now shown in FIG. 3 is a schematic view of the apparatus used to generate a heated liquid from the gaseous effluent using a heat exchanger 72 and a plurality of contained water tubes 76 which absorb the hot gaseous effluent and heats the water as it flows through the water tubes using the water circulation pump. Though it is contemplated the heat exchanger 72 uses a plurality of water tubes 76 and heat pipes as the means of thermal exchange, other heat exchange means including fire tube plate heat exchangers or coil style heat exchangers may be used.

In the current embodiment, a variable speed draft induction blower 71 affixed within the heat recovery module 20 creates fluid suction from the second combustion chamber 28 to the mounted heat exchanger 72 within the heat recovery exhaust stack 74. The hot gaseous effluent heats the enclosed liquid within the plurality of water tubes 76 where the heated liquid is circulated and eventually stored within the plurality of water storage tanks 34.

Figure 4:
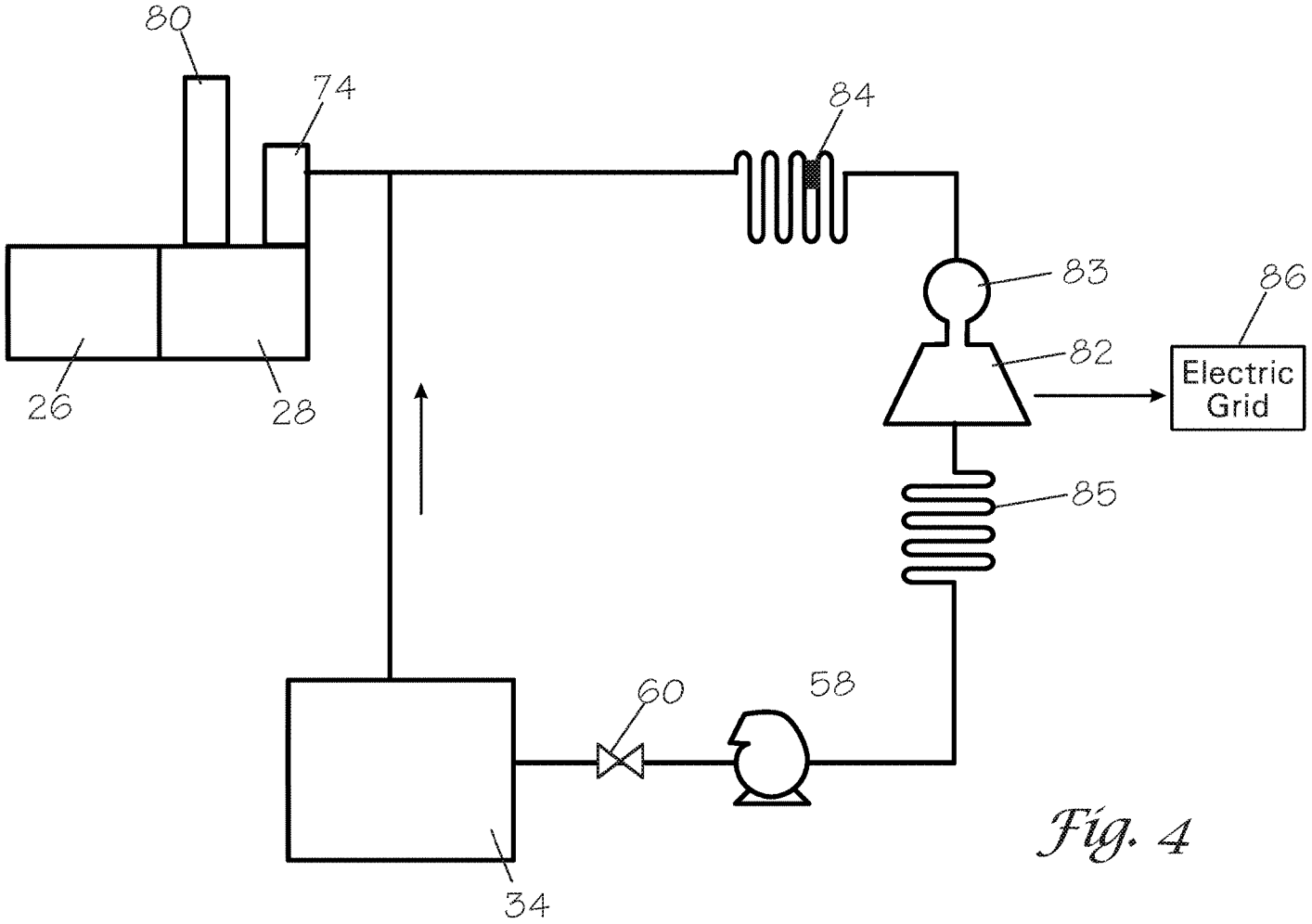
FIG. 4 is an alternative schematic view of the apparatus including the releasably attached thermoelectric generator used to produce electrical power.

Now shown in FIG. 4 is a schematic view of the apparatus 10 used to generate electrical power from the gaseous effluent using a thermoelectric generator or 82 or organic Rankine cycle unit 83 which converts the gaseous effluent to an electric power. When used to create electrical power, any generated power may be used internally by the system or distributed using electric grid 86. The current embodiment further allows for a cooling medium to be used to prevent overheating of the thermoelectric generator 82 or associated components. The coolant may be the cold liquid stored within the plurality of storage tanks 34 which absorb and recirculate any heat within the heat recovery system. Elements 84 and 85 are heat exchangers.

Figure 5:
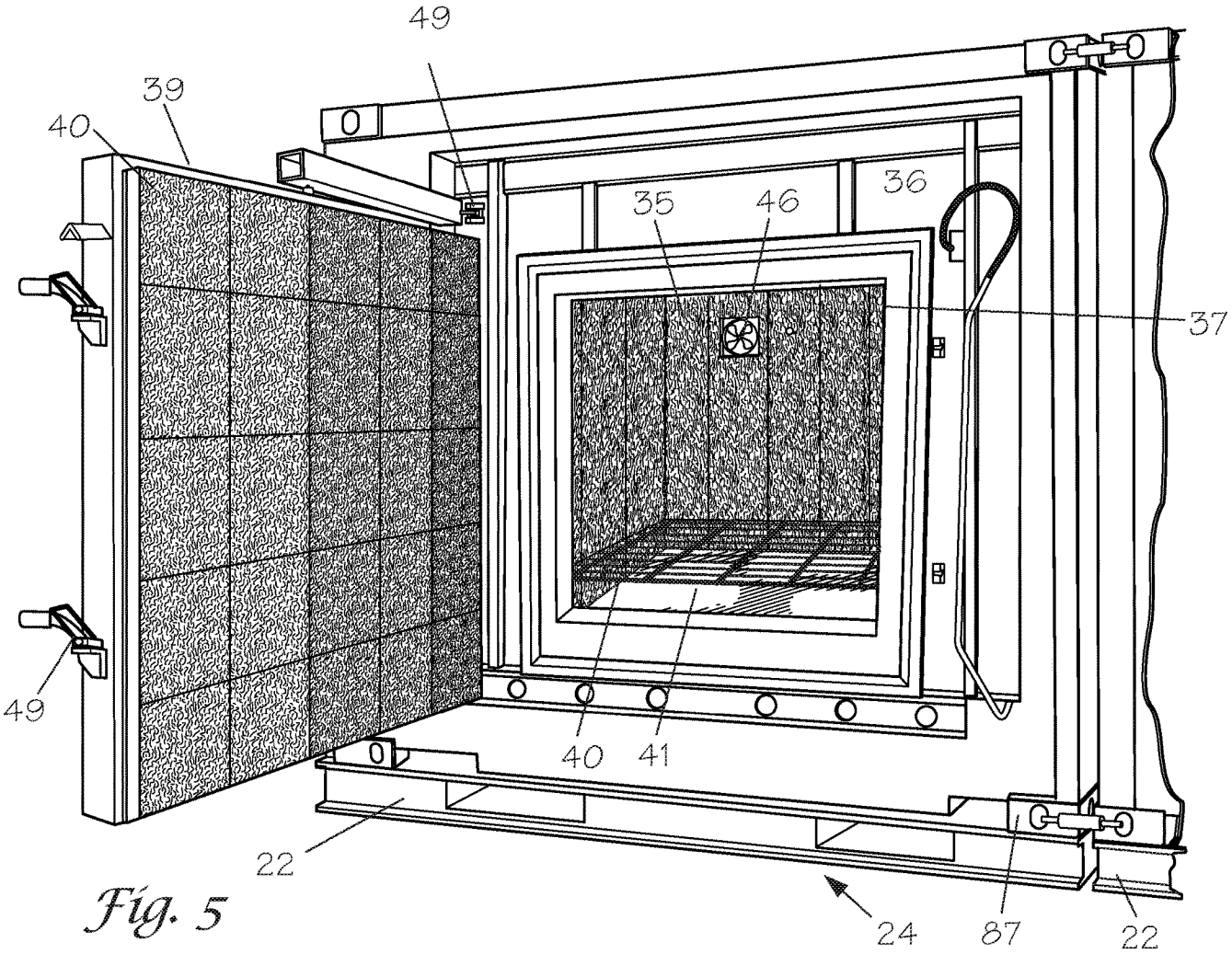
FIG. 5 is a detailed view of the primary gasification chamber.

Now shown in FIG. 5 is a detailed view of the primary gasification chamber 26 including the ceramic mortar floor 41 and refractory lining 35. The primary gasification chamber 26 weighs approximately 10,000 pounds and is secured to an integrated skid type base 22 to allow for convenient transport. The primary gasification chamber is releasably coupled to the less than 10,000-pound breech/control chamber 30 using a plurality of locking collars 87 attached to the iso comers blocks adjacent to the primary chamber door 39. When releasably detaching and separating the plurality of iso containers 14, the operator must first disconnect the primary 48 and secondary blowers 50, the primary 61 and secondary burner 62, and air duct 52 by undoing the fasteners 86 and disconnecting along the integrated sliding rail system 54. The apparatus 10 and attachment components are universally interchangeable within a unique code affixed to each component to enable rapid "break-down" without the need for a crane or forklift.

Figure 6:
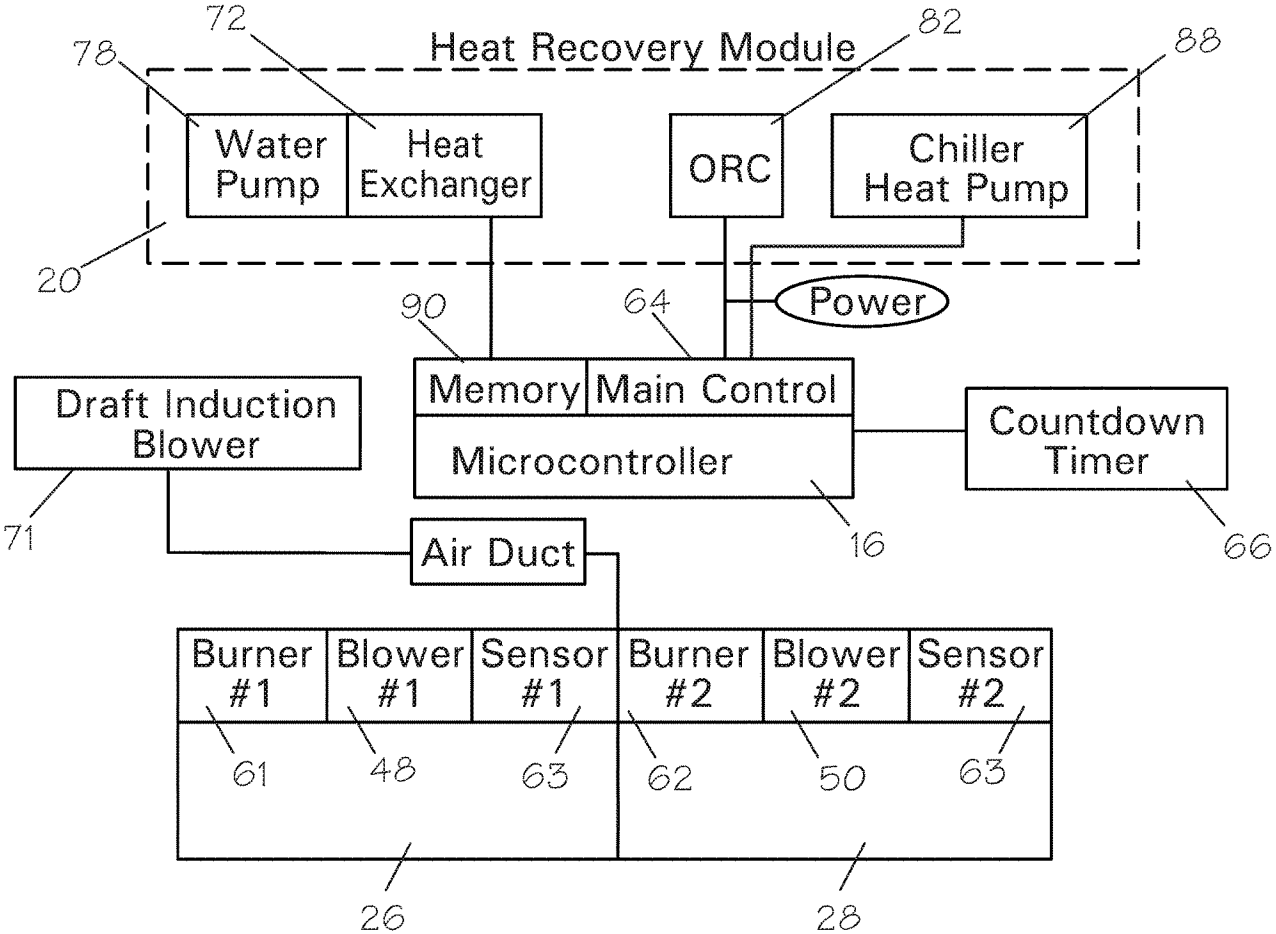
FIG. 6 is a block diagram of the microcontroller and control architecture.

Now shown in FIG. 6 is a block diagram depicting the control architecture of the microcontroller 16 which may be used to control the heat exchanger 72, thermoelectric generator 82, or chiller/heat pump 88. The microcontroller 16 may be a programmable logic microcontroller or processor-based microcontroller with an integrated memory module 96 which enables the storing of program instructions, component adjust data and pre-determined set point temperatures. The main control panel may be further equipped with a plurality of low light emitting diodes (LED) which allow manual entry of data to a touchscreen display or similar means for entering command inputs within the memory module 96. The main control panel allows for internal blackout capability to allow for operation under low/no light environments and may be switch between the "blackout mode" and require light emitting diodes by switching the on/off option.

It will be appreciated by persons skilled in the art that the present embodiment is not limited to what has been particularly shown and described hereinabove. In addition, unless mention was made above to the contrary, it should be noted that all of the accompanying drawings are not to scale. A variety of modifications and variations are possible in light of the above teachings without departing from the following claims.

What is claimed is:

1. A containerized waste-to-energy conversion apparatus, the apparatus comprising:

a plurality of combustion compartments configured to heat water via a hot effluent gas generated by multi-stage combustion of a solid waste, the plurality of combustion compartments including a primary gasification chamber and a secondary oxidation chamber, the secondary oxidation chamber having a main exhaust stack;

a breech/control chamber remove-ably interposed between the primary gasification chamber and the secondary oxidation chamber, the breech/control chamber having an elongated air duct configured to control gas flow from the primary gasification chamber to the secondary oxidation chamber;

a water storage tank configured to store hot water; and a heat recovery module having a heat exchanger through which water flows to be heated by hot gas from the secondary oxidation chamber such that when a capacity of the water storage tank is reached, hot gas is redirected from a heat recovery stack of the heat recovery module to the main exhaust stack.

2. The apparatus of claim 1, wherein the apparatus is further configured to be coupled with at least a thermoelectric generator to selectively produce electricity.

3. The apparatus of claim 2, wherein the apparatus is further configured to be coupled to at least a chiller/heat pump to selectively enable a heating process or a cooling process.

4. The apparatus of claim 1, wherein the plurality of combustion compartments further include a plurality of slide mounted components to enable a rapid deployment of the apparatus using a single operator.

5. The apparatus of claim 4, wherein the plurality of slide mounted components further includes at least a burner and an electric speed-controlled blower to maintain a pre-selected set point temperature within the primary gasification chamber and the secondary oxidation chamber.

6. The apparatus of claim 1, further including a microcontroller remotely operated at a user interface which enables an operator to control at least:

a set point temperature in the plurality of combustion compartments, first and second waste conversion chambers; and a variable frequency drive within the plurality of combustion compartments; and a water pump in fluid communication with the heat exchanger and the water storage tank.

7. The apparatus of claim 6, wherein the microcontroller further includes a low light emitting diode to enable a night vision mode on a display panel.

8. A mobile waste-to-energy recovery apparatus which is readily assemble-able using a slide rail mounted system, the apparatus comprising:

a plurality of combustion chambers in fluid communication and which enable a gasification of solid waste and oxidation of a contained gas, one of the combustion chambers being a gasification chamber and another of the combustion chambers being an oxidation chamber, the oxidation chamber having a main exhaust stack;

a heat recovery assembly releasably attached to the oxidation chamber and configured to produce at least a heated liquid in a closed-loop system from a gaseous effluent such that when a capacity of a water storage tank is reached, the gaseous effluent is redirected from a heat recovery stack of the heat recovery assembly to the main exhaust stack; and a microcontroller within one of the plurality of combustion chambers and configured to:

control a pre-selected set point temperature using a variable frequency drive electrically connected to at least one blower;

activate at least one modulating fuel operated burner to ensure the pre-selected set point is maintained with the plurality of combustion chambers;

provide a remotely operated interface to allow an operator to control at least the pre-selected set point temperature and a timed burn cycle;

power a water pump in fluid communication with a heat exchanger and water storage tank to circulate the heated liquid within the heat recovery assembly.

9. The apparatus of claim 8, wherein the plurality of combustion chambers further includes a light-weight ceramic fiber refractory lining which provides an enhanced combustion efficiency during the gasification/oxidation.

10. The apparatus of claim 8, further including an integrated skid type base with integrated ISO corner blocks/fork pockets which enables the apparatus to be handled with a forklift or a crane and be placed within a belly of an aircraft for ready transportation.

11. The apparatus of claim 10, wherein the plurality of combustion chambers includes the slide rail mounted system to allow a single operator to releasably attach to at least:

an elongated air duct between the gasification and the oxidation chambers;

at least one fuel operated burner within the gasification and the oxidation chamber, and at least one blower to cool the primary gasification chamber.

12. The apparatus of claim 11, wherein the elongated air duct further includes a duct blower fan electrically connected to a variable frequency drive to provide a turbulent air/gas mixture to enable a complete oxidation of the flue gas contained within the oxidation chamber.

13. The apparatus of claim 8, wherein the heat recovery assembly is further configured to be coupled with at least one thermoelectricity generator or organic Rankine cycle engine to selectively produce an electric power supply when placed in a heat recovery mode.

14. The apparatus of claim 8, wherein the heat recovery assembly is further configured to be coupled with at least one chiller/heat pump to selectively provide a cooling or heating when placed in the heat recovery mode.

15. The apparatus of claim 8, wherein each of the plurality of combustion chambers further includes a door having a safety switch to disable the gasification/oxidation if opened.

16. A mobile waste-to-energy recovery apparatus having a heat recovery module and is further readily assemblable using an integrated slide rail mounted system, the apparatus comprising:

a plurality of equilateral dimensioned combustion chambers in fluid communication to provide a multi-stage gasification of a solid waste with a further oxidation, one of the combustion chambers being a primary gasification chamber and another of the combustion chambers being a secondary oxidation chamber, the secondary oxidation chamber having a main exhaust stack;

the heat recovery module configured to produce at least a heated liquid from a gaseous effluent such that when a capacity of a water storage tank is reached, the gaseous effluent is redirected from a heat recovery stack of the heat recovery module to the main exhaust stack; and a microcontroller housed within a breech/control chamber and remotely connected to a main control panel and configured to:

regulate a plurality of pre-programmed set point temperatures using at least one mounted sensor within the primary gasification chamber and the secondary oxidation chamber;

control a fuel operated burner to heat the primary gasification chamber and the secondary oxidation chamber to enable a multi-stage gasification/oxidation;

receive a plurality of command inputs at the main control panel; and power a water pump in fluid communication with a heat exchanger of the heat recovery module; and the water storage tank to circulate the heated liquid within the heat recovery module.

17. The apparatus of claim 16, wherein the slide rail mounted system is further connected to:

an elongated air duct housed within the breech/control chamber and enables a fluid communication between the primary gasification chamber and the secondary oxidation chamber; and at least one fuel operated burner connected to the primary gasification chamber and the secondary oxidation chamber.

* * * * *